United States Patent [19]

Collonia

[11] 4,436,069

[45] Mar. 13, 1984

[54] SETTING DEVICE FOR THE CONTROLLED DISPLACEMENT OF A STOP CONNECTED WITH A SETTING MEMBER

[75] Inventor: Harald Collonia, Glashütten, Fed. Rep. of Germany

[73] Assignee: VDO Adolf Schindling AG, Frankfurt am Main, Fed. Rep. of Germany

[21] Appl. No.: 424,659

[22] Filed: Sep. 27, 1982

[30] Foreign Application Priority Data

Nov. 21, 1981 [DE] Fed. Rep. of Germany ..... 3146210

[51] Int. Cl.[3] ..... F02M 3/00

[52] U.S. Cl. ..... 123/339; 123/376; 123/198 DB

[58] Field of Search ..... 123/339, 389, 398, 400, 123/403, 376, 198 DB, DIG. 11; 261/65, DIG. 18, DIG. 19

[56] References Cited

U.S. PATENT DOCUMENTS

| | | | |
|---|---|---|---|
| 4,212,272 | 7/1980 | Hawk | 123/339 |
| 4,363,303 | 12/1982 | Takayama | 123/376 |
| 4,395,985 | 8/1983 | Hagey | 123/339 |

*Primary Examiner*—William A. Cuchlinski, Jr.
*Attorney, Agent, or Firm*—Martin A. Farber

[57] ABSTRACT

A setting device for the controlled displacement of a stop connected with a setting member, particularly an idling stop of an internal combustion engine.

The idling stop of the internal combustion engine should not be actuated by such a setting device when the internal combustion engine is intentionally operated at a speed of rotation above the idling speed. If it were, then the idling stop would be so displaced by a control electronic system during the intentional giving of gas that the internal combustion engine would run too slowly or die out upon the following idling. In order to avoid such displacement of the idling stop when the internal combustion engine is operating at travel speed without expensive interruption of the signal flow paths from and/or to the control electronic system, a clutch (3) is arranged between the stop pin and an electric motor as drive member. The clutch is connected with the stop pin (8) by a self-locking gearing (15). The clutch is capable of transmitting force only when the stop pin is to be displaced by the idle or control electronic system since in this case the spring connected with the throttle valve strikes, via the stop (14), against the stop pin (8) and presses the two clutch parts (4, 5) together.

10 Claims, 1 Drawing Figure

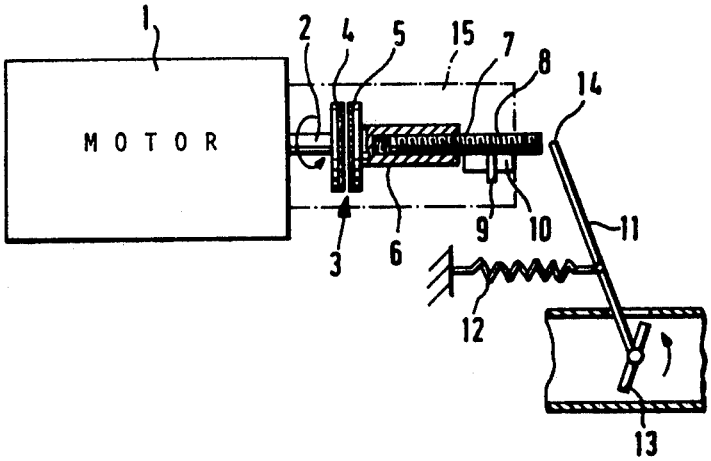
1
MOTOR
2
4
5
15
7
8
14
3
6
9
10
11
12
13

SETTING DEVICE FOR THE CONTROLLED DISPLACEMENT OF A STOP CONNECTED WITH A SETTING MEMBER

The present invention relates to a setting device for the controlled displacement of a stop connected with a setting member, particularly of an idling stop of an internal combustion engine which is pressed by a spring against a stop pin which is displaceable by an electric drive member and which, with the opening of a force-locked connection to the electric drive member, can be actuated independently of the latter.

Such known setting devices are used in particular to actuate an adjustable idling stop on a throttle valve of an internal-combustion engine or on the displacement lever of a diesel engine. In order to control the idling speed, a control electronic system is used which is fed with signals corresponding to the speed of rotation and possibly to other switch variables, such as temperature, and which gives off a setting signal to an electric drive member of the setting device. As drive member there is employed, for instance, a motor which displaces a stop pin against which the idling stop is pressed in its turn by a spring, the throttle-valve return spring. In this way, the setting member, namely the throttle valve, is so displaced by the drive member that a desired idling speed is maintained regardless of disturbing variables. This is true in any event as long as the throttle valve is not intentionally displaced by the gas pedal in order to operate the engine at a speed other than the idling speed. In such case the idle electronic system would give off a setting signal which attempts to bring the internal-combustion engine to a lower speed. If the gas pedal is then again returned to its position of rest, the idling speed would be too low and, in the extreme case, so low that the internal combustion engine stalls. Therefore, in the known setting device a so-called idling contact is provided which interrupts a signal line upon actuation of the gas pedal so that the idle electronic system does not counter-control upon an intentional increase in speed. The idling contact can be formed of two contact pieces, one of which is connected with the stop pin at the drive member and the other with the idling stop itself. This manner of deactuating the idle control circuit or the idle electronic system for the displacement of the stop pin upon the giving of gas in traveling so that the stop pin retains the last position at which it was set at idle is, however, relatively expensive. This expense results not only from the idling contact but from an additional circuit part in the idle electronic system for the evaluation of the position of the idling contact and from the adjustment of the idle contact.

The object of the present invention therefore includes further development of a setting device of the aforementioned type in such a manner that the idling adjustment is made ineffective for the displacement of the setting member in a less expensive manner.

This object is achieved by an embodiment of the setting device which is characterized by the fact that a clutch (3) having a first clutch part (5) which is displaceable against a second clutch part (4) is arranged as drive member between the stop pin (8) and an electric motor (1), and that a self-locking gearing (15) which converts rotary motion into a translation of the stop pin is so arranged between the stop pin and the displaceable clutch part (5) that the clutch becomes force-locked by pressure of the spring (12), via the stop (14), on the stop pin.

In this setting device, the rotation of an electric motor is transmitted to the stop pin only when the stop pin is acted on by the spring, the throttle valve return spring. This takes place only upon idling, when the gas pedal is not depressed by the driver. In such case therefore the rotation of the electric motor is converted by the self-locking gearing into a translation of the stop pin. The stop pin is so adjusted by the idle or control electronic system that the internal combustion engine operates at the desired idling speed. Upon depression of the gas pedal, the first force-locked connection between the stop pin and the stop is eliminated since the setting member is intentionally displaced by the driver independently of the idling adjustment in order to reach the desired speed. In this way, the force-locked connection of the clutch is also interrupted, since the displaceable clutch part is now not pressed by the spring—the throttle-valve return spring—against the other clutch part. The electric motor can, accordingly, rotate as desired without causing a corresponding displacement of the stop pin. Accordingly, the control or idle electronic system can also give the electric motor setting signals which depend on the intentionally adjusted engine speed. Nevertheless, the electric motor in this case does not undesirably displace the stop pin due to the disconnected coupling.

From this there follow the essential advantages of the invention, namely that an interruption of the electric signal paths in the idle control circuit can be completely dispensed with. No idle contact and no circuit part of the idle or control electronic system is required for the evaluation of the position of the idling contact. Accordingly, adjustment of the idling contact is also dispensed with. The interruption of the force-locked connection by the clutch takes place, on the other hand, in uncomplicated fashion automatically by the action of the spring—the throttle-valve return spring. The expense for mechanical structural parts of the setting device for the interruption of the idle control circuit upon the adjustment of the stop pin is comparatively slight.

A particularly low-cost embodiment of the setting device consists therein that the self-locking gearing (15), which is provided between the stop pin and the displaceable clutch part, consists of a threaded bar (6) which is connected with the clutch (3) and of a threaded section (7) of the displaceable stop pin (8) which engages therein, the pin being secured against turning. This self-locking gearing which consists essentially of only two parts converts the rotation of the clutch part connected with it into translation of the stop pin in the manner that the threaded rod turns to a greater or lesser extent in the threaded section of the stop pin which is mounted for translation but not rotation. Since the threaded bar and the threaded section cannot shift further against the fixed clutch part, there remains only the desired translation of the stop pin in the direction towards the stop of the setting member. This translation takes place, corresponding to the function sketched above, only when the stop is pressed in force-locked manner against the stop pin.

One detail of the uncomplicated self-locking gearing which has been described above consists in the fact that for the securing against rotation a slide pin (9) which is connected to the stop pin (8) is displaceable along a stationary slide surface (10).

Instead of the special gearing described above, it is possible, in a variant, also to use a worm gearing as a self-locking gearing.

As clutch, a friction clutch (3) may advantageously be provided between the electric motor (1) and the stop pin (8), in which case the force-locking can take place in any position of rotation of the clutch parts.

Instead of this, a jaw clutch can also be used, it being capable, by means of a force-locked and form-locked connection, of transmitting the rotation of the electric motor to the gearing when the stop pin is acted on.

A preferred embodiment of the invention will be described below with reference to the drawing in which:

The only FIGURE is a schematic view partically in longitudinal section, of a setting device for the controlled displacement of a stop connected with a setting member of the invention.

Referring to the drawing, 1 is an electric motor which is fed with setting signals by an idle or control electronic system (not shown), the signals depending in particular on the speed of rotation of an internal combustion engine, not shown. A friction clutch 3 having two clutch halves 4 and 5 is connected with a driven shaft 2 of the motor.

Out of the clutch part 5, which is displaceable with respect to the clutch part 4, a threaded rod 6 having an internal thread has been developed. Into the internal thread there engages an external thread of a threaded section 7 which is threaded in a stop pin 8.

A pin 9 on the stop pin 8 can slide along a slide surface 10.

The stop pin 8 limits the displacement of a lever 11 by a spring 12 which serves a throttle-valve return spring. The throttle valve is designated 13. Neither it nor the lever 11 or the spring 12 has been shown in proper scale as compared with the setting device. The end of the lever 11 which faces the front of the stop pin is also designated as stop 14.

A separating spring (not shown in the drawing) sees to it that the clutch halves 4 and 5 are separated from each other when they are not pressed against each other by the force of the spring 12. The spring force of the spring 12 is for this purpose substantially greater than that of the separating spring.

In the open position of the clutch 3 shown in the drawing, the motor 1 can be fed with any desired setting signals without causing displacement of the stop pin and thus of the idling speed. It is therefore not necessary to interrupt the electric signal paths to the idle or control electronic system in any manner or make them inactive when the gas pedal is intentionally actuated by the driver, as a result of which the stop 14 of the lever 11 is removed from the stop pin 8 so that the stop pin is no longer acted on by the spring 12. In this case the clutch parts 4 and 5 are separated by the separating spring.

However, if the gas pedal is released then the stop pin 8 is acted on by the spring 12, i.e. the stop pin presses the clutch part 5 against the clutch part 4, producing a force-locked connection with the clutch. In that case, the rotation of the electric motor 1 is converted into translation of the stop pin 8 in order to set the desired idling speed. By the connection of the friction clutch 3, which connection in this case is force-locked, the rotation is transmitted to the threaded rod 6 which screws the threaded part 7 of the stop pin in or out to a greater or lesser extent depending on the direction of rotation, since the stop pin cannot turn. Rather, rotation is prevented by the pin 9 which, upon displacement of the stop pin, slides along the slide surface 10. As a whole, therefore, the rotation of the electric motor 1 is converted into translation of the stop pin 8 and thus of the stop 14 of the throttle valve 13. This adjustment of the stop pin is retained upon renewed actuation of the gas pedal since here, once again, the force-locked connection of the friction clutch 3 is opened.

I claim:

1. In a setting device for controlled displacement of a stop connected with a setting member, particularly an idling stop of an internal combustion engine which is pressed by a spring against a stop pin, the latter being displaceable by an electric drive member, and the stop being actuatable independently of the latter with opening of a force-locked connection to the electric drive member, the improvement wherein the electric drive member is an electric motor, the force-locked connection is constituted by a clutch having a first clutch part and a second clutch part, said first clutch part being displaceable to engagement against said second clutch part, said second clutch part constitutes a driving member operatively connected between the stop pin and the electric motor, a self-locking gearing means for converting rotary motion of said first clutch part into a translation of said stop pin, said gearing means is arranged between the stop pin and said displaceable first clutch part such that said clutch becomes engaged force-locked by force of the spring on the stop pin via the stop.

2. The setting device as set forth in claim 1, wherein said self-locking gearing means comprises, a threaded sleeve connected with said first clutch part and a threaded section of said displaceable stop pin, said threaded section engages in said threaded sleeve, means for preventing said stop pin from against turning.

3. The setting device as set forth in claim 2, wherein said preventing means comprises, a pin connected to said stop pin, a stationary slide surface, said stop pin slidably engages against said stationary slide surface.

4. The setting device as set forth in claim 1, wherein said self-locking gearing means constitutes a worm gearing.

5. The setting device as set forth in claim 1, wherein said clutch is a friction clutch.

6. The setting device as set forth in claim 2, wherein said clutch is a friction clutch.

7. The setting device as set forth in claim 1, wherein said clutch is a jaw clutch constituting means for transmitting rotation of the electric motor via a force-locked and form-locked connection to said gearing means when the stop pin is acted on.

8. The setting device as set forth in claim 2, wherein said clutch is a jaw clutch constituting means for transmitting rotation of the electric motor via a force-locked and form-locked connection to said gearing means when the stop pin is acted on.

9. The setting device as set forth in claim 1, wherein said clutch being disengaged whenever said stop is spaced from said stop pin.

10. The setting device as set forth in claim 1, wherein said clutch becomes engaged force-locked by force of the spring on the stop pin via the stop when said setting member is not actuated independently of the electric drive member.

* * * * *